US008935870B2

(12) United States Patent
Dent

(10) Patent No.: US 8,935,870 B2
(45) Date of Patent: Jan. 20, 2015

(54) POLE SIGN ATTACHMENT SYSTEM

(71) Applicant: Clifford M. Dent, Buckeye, AZ (US)

(72) Inventor: Clifford M. Dent, Buckeye, AZ (US)

( * ) Notice: Subject to any disclaimer, the term of this patent is extended or adjusted under 35 U.S.C. 154(b) by 0 days.

(21) Appl. No.: 14/199,683

(22) Filed: Mar. 6, 2014

(65) Prior Publication Data

US 2014/0250748 A1 Sep. 11, 2014

Related U.S. Application Data

(60) Provisional application No. 61/774,469, filed on Mar. 7, 2013.

(51) Int. Cl.
*G09F 15/00* (2006.01)
*G09F 7/18* (2006.01)

(52) U.S. Cl.
CPC ..... *G09F 7/18* (2013.01)
USPC ..... 40/607.12

(58) Field of Classification Search
USPC ..... 40/607.12, 606.01
See application file for complete search history.

(56) References Cited

U.S. PATENT DOCUMENTS

| | | | | |
|---|---|---|---|---|
| 4,890,403 | A * | 1/1990 | Dinan | 40/604 |
| 6,192,611 | B1 * | 2/2001 | Molla | 40/604 |
| 6,976,660 | B2 * | 12/2005 | Lapointe et al. | 248/218.4 |
| 8,539,703 | B2 * | 9/2013 | DeMarco | 40/607.12 |
| 8,627,587 | B2 * | 1/2014 | O'Dell | 40/607.12 |

* cited by examiner

*Primary Examiner* — Gary Hoge
(74) *Attorney, Agent, or Firm* — Seed IP Law Group PLLC

(57) ABSTRACT

A pole sign system having a pole, a sign, and a pole clamp attachment assembly that includes a perforated square tubing attached to a back surface of the sign, a cable configured to be wrapped around the pole and having first and second ends, and a pair of teethed clamps on each end of the cable, each clamp configured to be attached to the square tubing on the sign and adjustably tightened to the cable and the pole.

8 Claims, 8 Drawing Sheets

POLE SIGN ATTACHMENT SYSTEM

BACKGROUND

1. Technical Field

The present disclosure pertains to the mounting of signs to tubular poles and, more particularly, to a wraparound pole cable and clamp attachment system.

2. Description of the Related Art

Wraparound cable mounting assemblies for attaching a flat sign to a tubular pole are known. However, one drawback to such systems is the need for special crimping tools for tightening each side of the cable to the clamp structure. Another drawback is that many of the existing clamps require bending or kinking of the cable in order to provide plenty of tightening ability. Many existing units are subject to twisting and turning when subjected to high winds, requiring the use of personnel and special tools to readjust the sign to the proper orientation.

BRIEF SUMMARY

The present disclosure is directed to a wraparound cable and clamp assembly used to attach a flat sign to a tubular post. The clamp includes an adjustable notched side member that enables the clamp to be attached in 1-inch intervals across the flat surface of any perforated square or round tubing or any other pipe or tubing design that is already or easily punched and widely available to most sign suppliers and contractors in the marketplace.

In accordance with another aspect of the present disclosure, the system utilizes a wraparound pole cable with both ends having a substantial range of tightening without requiring bending or kinking of the cable and having sufficient room to tighten each side without the need for special crimping tools.

The advantage of the present disclosure is that provides a system that will enable adjustment from the smallest signpost in the 3-inch range to the largest sign posts in the 20-inch range by selecting the proper length of cable and changing the adjustable notched sides of the clamp to the correct size. This enables the sign panel to be attached to the opposite side of the perforated unit on the sign that is attach with rivets or bolts or other conventional means.

In accordance with another aspect of the present disclosure, the system includes washers that have one side that is rounded for vertical adjustment, if needed. The system also is adaptable to tapered poles, and it prevents the sign panel from turning in the wind. Only the use of standard hand tools for tightening will be required, and the components will withstand full torque values if required by the application. No special training or knowledge is required to install, adjust, or replace the pole sign attachment system.

In addition, large signs or heavy signs can easily be mounted using double- or multiple-clamp arrangements. One clamp would be positioned across the top of the sign panel and one clamp would run across the bottom of the sign panel, and a center clamp could also be used if needed. This increases the tightening ability and the gripping and holding of the sign panel to the pole structure.

BRIEF DESCRIPTION OF THE SEVERAL VIEWS OF THE DRAWINGS

The foregoing and other features and advantages of the present disclosure will more readily appreciated as the same become better understood from the following detailed description when taken in conjunction with the accompanying drawings, wherein.

DETAILED DESCRIPTION

Figure 2:
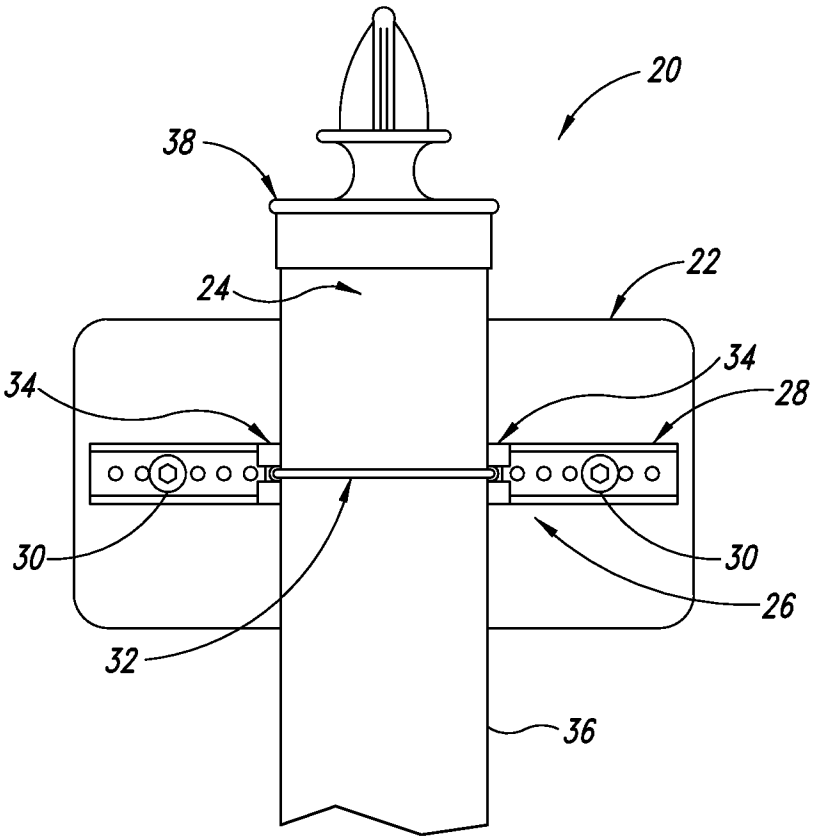
FIG. 2 is a back plan view of the pole sign attachment system of FIG. 1.
Figure 1:
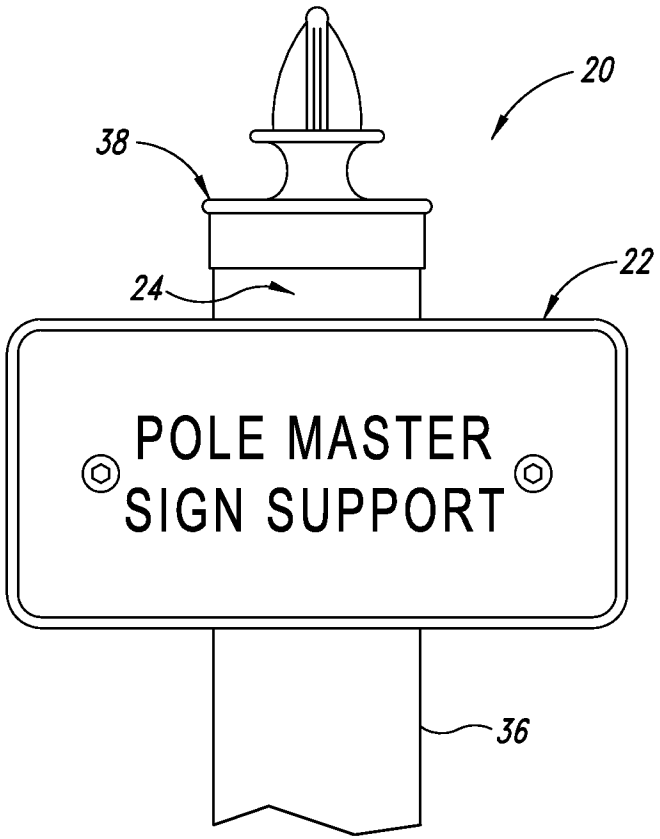
FIG. 1 is a front plan view of a sign attached to a tubular pole using the pole sign attachment system of the present disclosure.

Referring initially to FIGS. 1 and 2, shown therein are a pole sign attachment system 20 having a flat sign 22 attached to a tubular post 24 using an adjustable pole clamp assembly 26 in accordance with the present disclosure. In accordance with one aspect of the present disclosure, the system can include a standard piece of perforated square tubing 28 attached to the back of the sign 22 with fasteners 30 in a conventional manner. The adjustable pole clamp assembly 26 includes a cable 32 and first and second side clamps 34 attached to each end of the cable 32 and to the perforated square tubing 28.

Ideally, 3/16-inch stainless steel cable (1-19) 32 and two clamps 34 are used for a typical sign panel. It is to be understood, however, that additional square tubing 28 and adjustable pole clamp assemblies 26 can be used for signs that are higher or wider or both, including an adjustable pole clamp assembly at the top, the bottom, and, if required, horizontally across the middle.

The tube 24 has a circular body 36 that may or may not have a hollow interior and is capped at the top with a cap 38.

Figure 3:
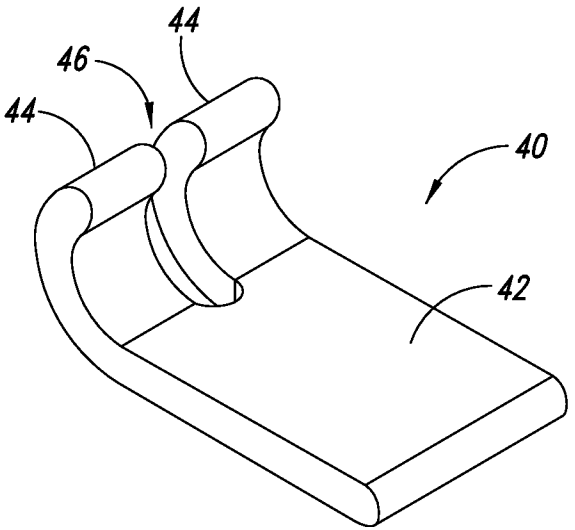
FIG. 3 is an isometric view of a sign clamp main plate; This is an inside view showing the measurements of the notch and the bend.

Referring next to FIG. 3, shown therein is a main plate 40 for use in forming the clamp 34. The main plate includes a base plate portion 42 and a pair of curved claws 44 in spaced parallel relationship depending from the main plate 42 and defining a slot 46 therebetween. The slot 46 is sized and shaped to accommodate the 3/16-inch stainless steel cable 32.

Figure 4:
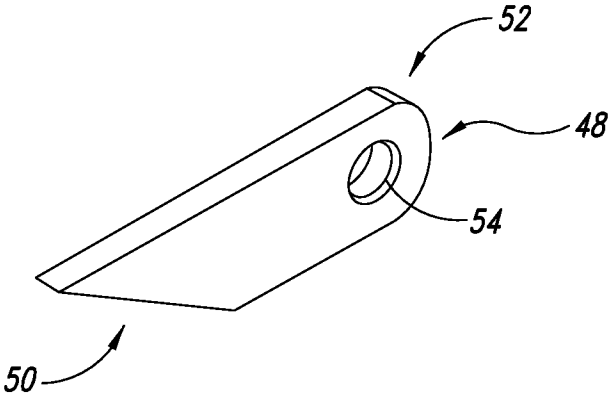
FIG. 4 is an isometric view of a sign clamp mounting strap configured to be attached to the sign clamp main plate of FIG. 3.

FIG. 4 illustrates a sign clamp mounting strap 48 having an angled first end 50 and a semicircular second end 52 with a substantially elongate, flat shape. The strap 48 preferably has a through-opening 54 formed adjacent the semicircular end 52, which is preferably chamfered. Ideally the strap is made from 1/4-inch by 1-inch medium carbon hardness metal. Similarly, the main plate is made from 1045 medium carbon hardness material.

Figure 5:
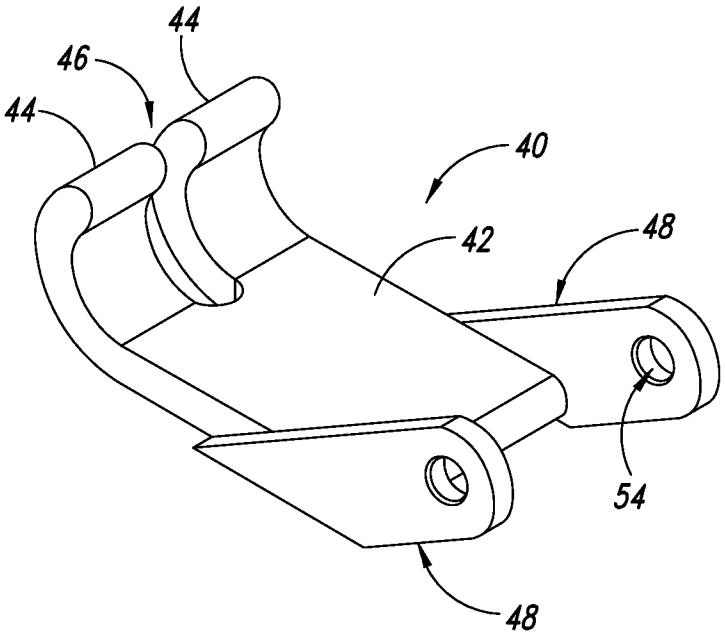
FIG. 5 is an isometric view of the sign clamp main plate with the mounting straps attached to each side thereof.

Referring next to FIG. 5, shown therein are a pair of mounting straps 48 depending from the main plate 42 on an end opposite of the claws 44. The straps 48 are preferably in spaced parallel relationship and placed with the flat sides abutting the edges of the main plate body 42 so that the angled sides 50 are coplanar with the backside of the main plate 42. This is shown in more detail in FIGS. 7A-7C, described below.

Ideally the sign clamp straps can be welded to the main plate 40 in a conventional manner that will not be described in more detail herein. Alternatively, the part can be cast as an integrated component so that the straps are integral with the main plate body 42.

Figure 7A:
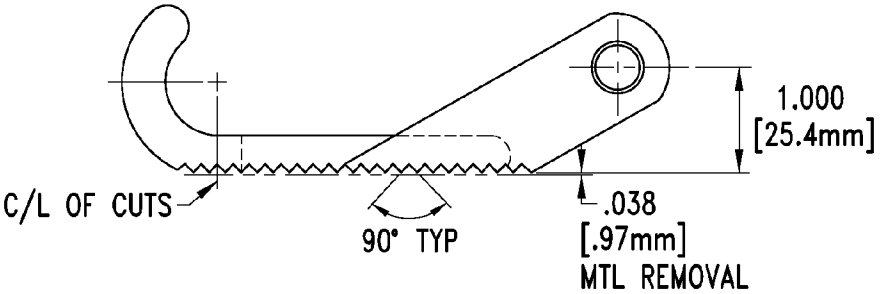
FIGS. 7A-7C are a side plan view, bottom plan view, and enlarged partial side view of the sign clamp of FIG. 6.
Figure 7B:
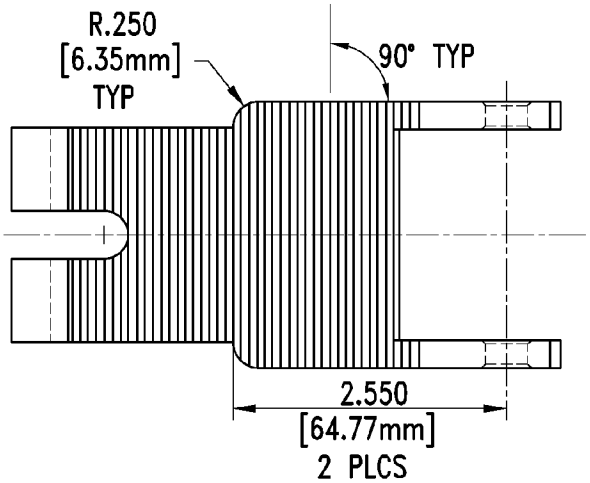
Figure 6:
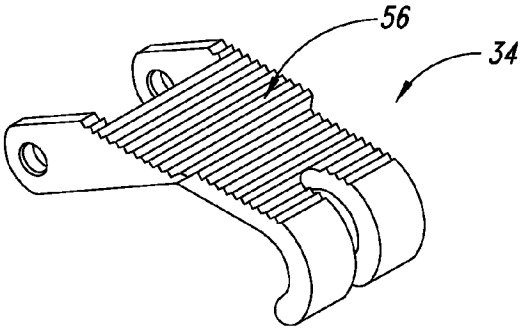
FIG. 6 is a bottom isometric view of the sign clamp showing machining detail.
Figure 7C:
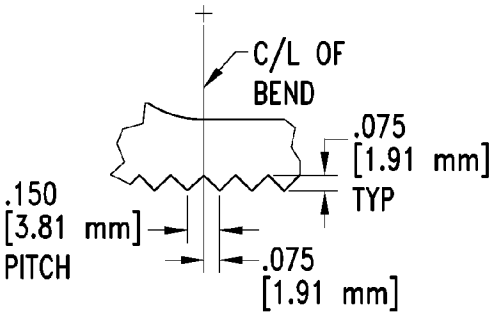

FIG. 6 is an isometric view of the backside of the sign clamp 34 showing the formation of teeth 56 on the backside of the main plate body 42. These teeth are preferably cut to have a 90-degree angle and a depth of approximately 0.038 inches (0.97 millimeters) as shown in FIG. 7A. More detail about the cuts is shown in FIG. 7C, as well as in the plan view of FIG. 7B.

Figure 8:
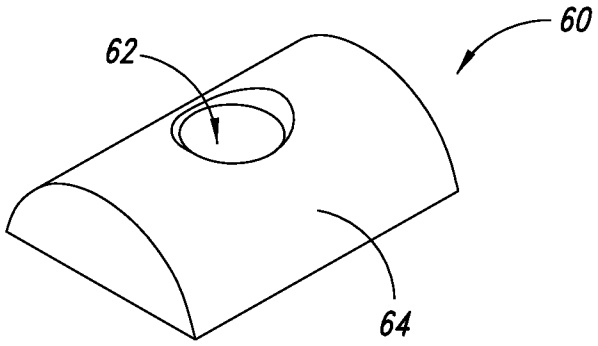
FIG. 8 is an isometric view of a sign clamp pivot bar formed in accordance with the present disclosure.

FIG. 8 illustrates a pivot bar 60 to be used with the cable 32, as described in more detail herein below. The pivot bar is a curved washer made the same width as the sign clamp side and is used to keep the cable adjustment and tightener straight for a direct pull while being tightened. By keeping the cable straight it allows the tightening nut to be tightened using no special tools. While the post structure gets bigger in size the pivot rod just slides in the bent section on the clamp to keep it straight.

Figure 9:
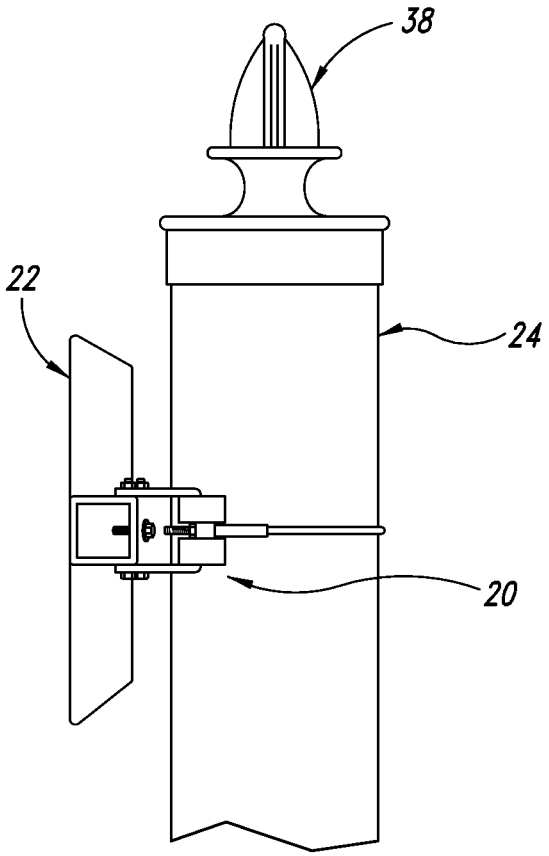
FIG. 9 is an isometric side view of the pole sign attachment system as installed.
Figure 10:
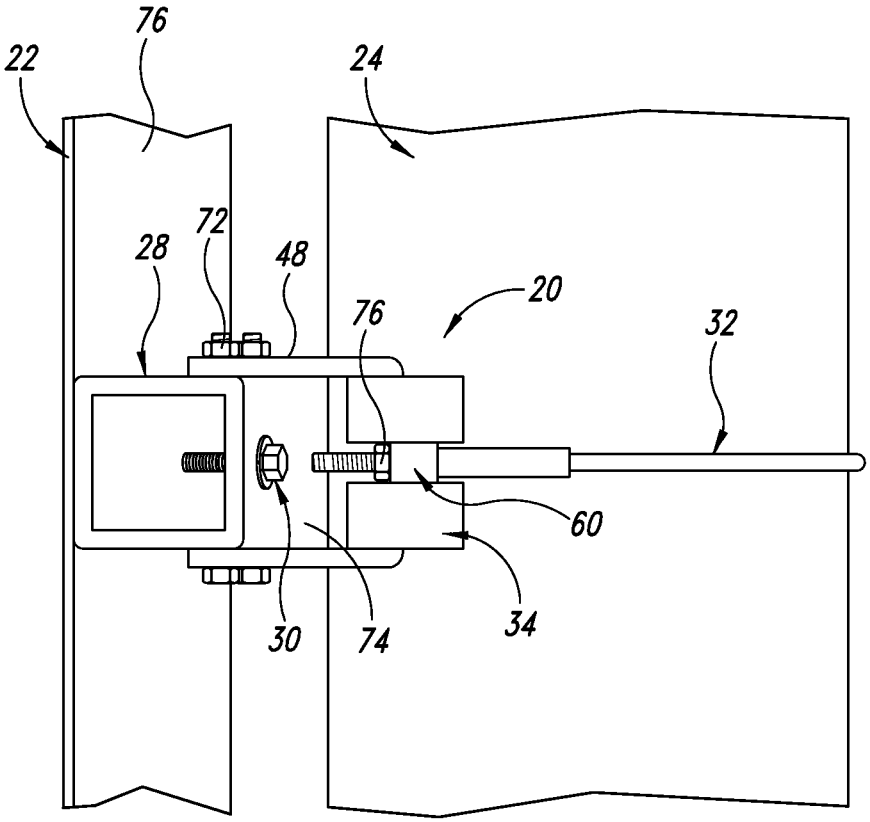
FIG. 10 is an enlarged view of the pole sign attachment system of FIG. 9.
Figure 11:
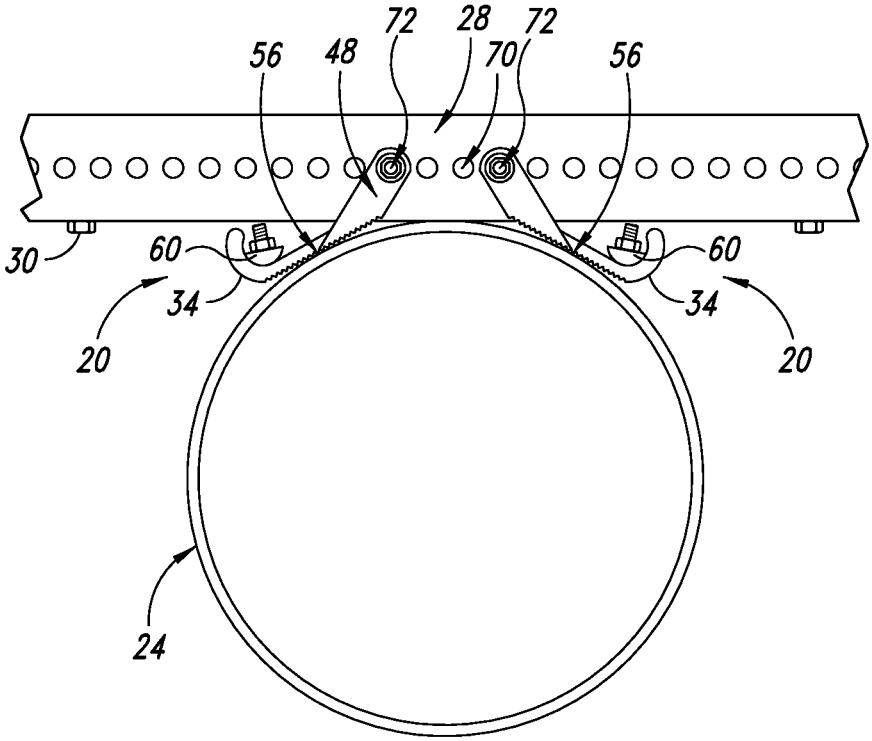
FIG. 11 is a top isometric view of the pole sign attachment system of FIG. 9.

FIGS. 9-11 illustrate the pole sign attachment system 20 installed on a tubular post or pole 24 having the top capped with the cap 38. The pole attachment system 20 attaches the sign 22 to the pole 24 via the perforated tubing 28, shown more clearly in FIGS. 10 and 11. This tubing 28 has a plurality of vertical and horizontal openings, of which the vertical openings 70 can be seen in FIG. 11. Each clamp 34 is attached to the horizontal tubing 28 via conventional fasteners 72 passing through the openings 54 in the mounting straps 48.

In a preferred embodiment, the spacing between the mounting straps 48 on the clamp 34 is approximately 2 inches, although different sizes can be used to accommodate different installations. For example, the standard perforated horizontal bar 28 is approximately 2 inches square to 2.5 inches square and is a readily commercially available component. The horizontal bar 28 is attached to the sign back 76 with the conventional fastener 30 through the horizontal openings as shown in FIGS. 9-11. A standard National Coarse thread bolt will pass through an upper and lower hole 70 in the horizontal bar 28 as well as through the openings 54 in the straps 48.

Next, the sign clamp pivot bar 60 has a curved wall 64 and chamfered opening 62 formed centrally through the body thereof. The curved wall 64 of the pivot bar 60 is placed within the saddle portion of the concave claws 44 of the clamp 34 as shown in the top view of FIG. 11. Once the pivot bar 60 is placed in this concave curved saddle area of the claws 44, the cable 32 is installed around the tubular post 24 with each end 74 of the cable 32 inserted through the opening 62 in the pivot bar 60. Ideally, each end 74 of the cable 32 is a threaded post configured to receive a conventional nut 76 in threadable engagement to hold the cable to the pivot bar 60. This in turn holds the cable 32 to the clamp 34, and tightening of the nut 76 pulls the cable 32 and the clamp 34 tight against the tubular post 24.

As shown in the top view of FIG. 11, the teeth 56 of the clamp 34 engage the outside curved surface of the tubular post 24 to prevent movement of the clamp 34 relative to the tube 24. This maintains the sign 22 in fixed spaced relationship to the tubular post 24.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A pole sign system, comprising:
- a pole;
- a sign; and
- a pole clamp attachment assembly that includes:
  - a perforated square tubing attached to the back surface of the sign;
  - a cable configured to be wrapped around the pole and having first and second ends; and
  - a pair of clamps, one clamp on each end of the cable, each clamp configured to be attached to the square tubing on the sign.

2. The system of claim 1 wherein each clamp has a back surface with a plurality of teeth formed therein for gripping the tube.

3. The system of claim 2 wherein each clamp includes a pair of claws in spaced parallel relationship to define a slot sized and shaped to receive the cable, each claw having a saddle portion.

4. The system of claim 3, comprising a pivot bar having a body with a curved wall and a chamfered opening formed centrally through the body, the curved wall is configured to be placed within the saddle portion of the claws.

5. An apparatus for attaching signs to a pole, comprising:
- a pole clamp attachment assembly that includes:
  - a perforated square tubing configured to be attached to a back surface of the sign;
  - a cable configured to be wrapped around the pole and having first and second ends; and
  - a pair of clamps, one clamp configured for attachment to each of the first and second ends of the cable, each clamp configured to be attached to the square tubing on the sign.

6. The system of claim 5 wherein each clamp has a back surface with a plurality of teeth formed therein for gripping the tube.

7. The system of claim 6 wherein each clamp includes a pair of claws in spaced parallel relationship to define a slot sized and shaped to receive the cable, each claw having a saddle portion.

8. The system of claim 7, comprising a pivot bar having a body with a curved wall and a chamfered opening formed centrally through the body, the curved wall is configured to be placed within the saddle portion of the claws.

* * * * *